US005635887A

United States Patent [19]

Fischette et al.

[11] Patent Number: 5,635,887

[45] Date of Patent: Jun. 3, 1997

[54] COMPACT RARE EARTH MAGNET SECURITY SWITCH ASSEMBLY

[75] Inventors: Robert G. Fischette; Scot R. Newport, both of Portland, Oreg.

[73] Assignee: Sentrol, Inc., Tualatin, Oreg.

[21] Appl. No.: 595,525

[22] Filed: Feb. 1, 1996

[51] Int. Cl.[6] ..... H01H 9/00

[52] U.S. Cl. ..... 335/205; 335/207

[58] Field of Search ..... 335/205, 206, 335/207

[56] References Cited

U.S. PATENT DOCUMENTS

| | | | |
|---|---|---|---|
| 3,896,404 | 7/1975 | Peterson . | |
| 4,242,657 | 12/1980 | Chaillot . | |
| 4,571,528 | 2/1986 | McGee et al. | 318/138 |
| 4,700,163 | 10/1987 | Wolfe, Jr. . | |
| 4,827,091 | 5/1989 | Behr . | |
| 4,903,010 | 2/1990 | Greene . | |
| 4,933,515 | 6/1990 | Behr et al. . | |
| 5,416,456 | 5/1995 | Light . | |
| 5,438,869 | 8/1995 | Mueller et al. | 73/431 |

OTHER PUBLICATIONS

Cookson Magnet Sales, Inc., *High Performance Permanent Magnets 4*, Magnet Sales and Manufacturing Company, 1993.

*Primary Examiner*—Lincoln Donovan

*Attorney, Agent, or Firm*—Stoel Rives LLP

[57] ABSTRACT

A method and an apparatus employing a compact magnetic security switch for detecting the open or closed position of corresponding fixed frame and movable closure members, such as door and window assemblies, of entryways of buildings. The security switch assembly includes a high intrinsic coercive force rare earth, preferably neodymium, alloy magnet mountable on a movable closure member within a close clearance and within a predetermined gap and break distance of a switch mounted on a corresponding fixed frame member when in closed position, such that the electrical contacts interact with the magnet and thereby place the switch in a nonalarm position. The method of the present invention provides for mounting the rare earth alloy magnet without invading the subsurface structural integrity of the movable closure member. The rare earth alloy magnet has a generally flat configuration and is adaptable to unobtrusive and noninvasive shallow recess or surface mounting in tight-fitting structures having close clearances.

22 Claims, 5 Drawing Sheets

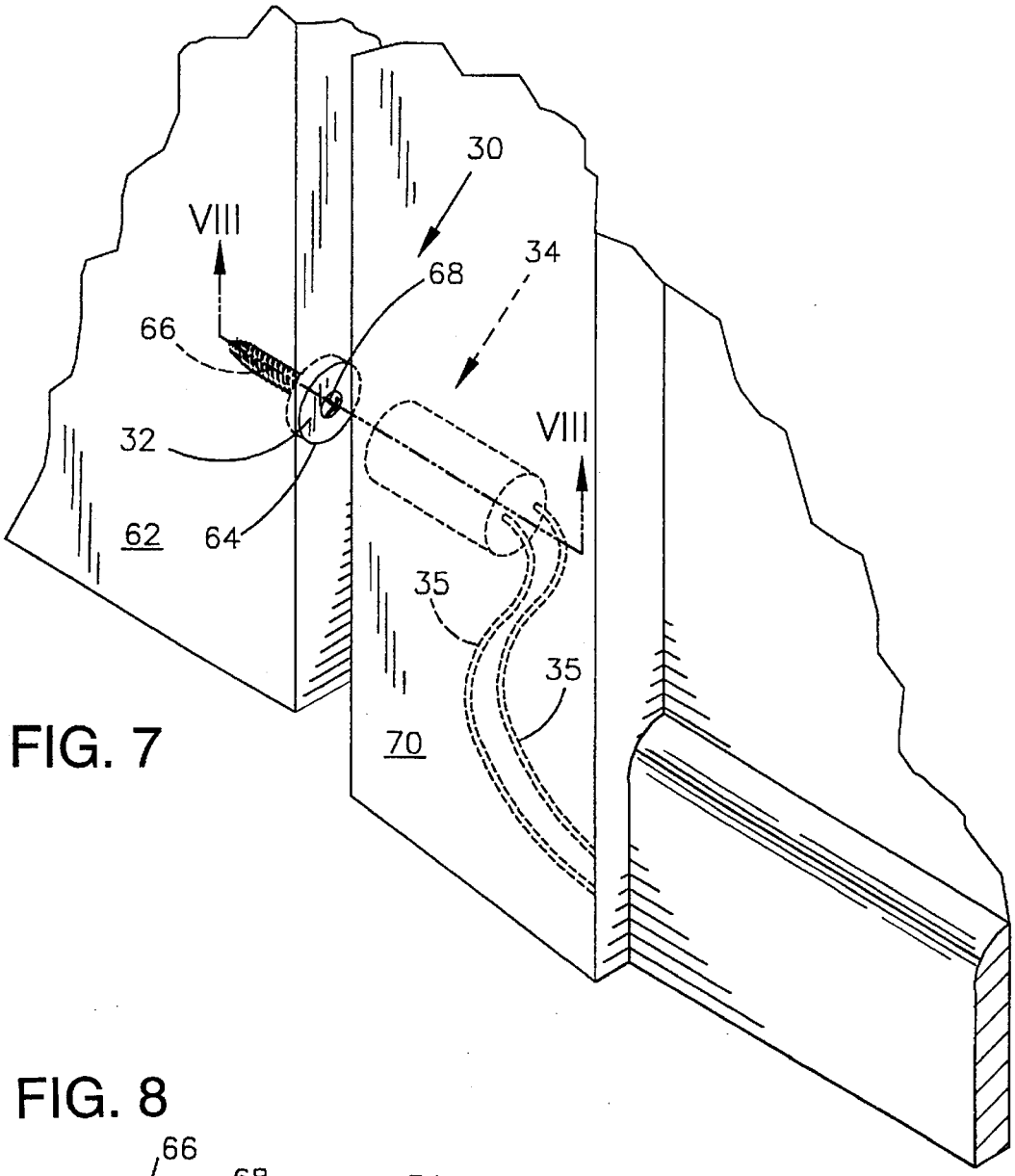
FIG. 7
FIG. 8
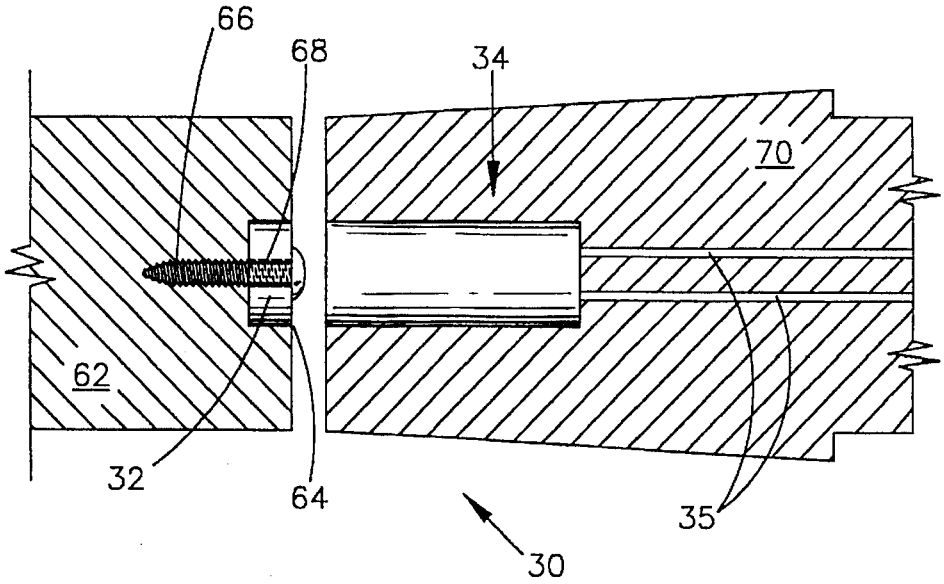

COMPACT RARE EARTH MAGNET SECURITY SWITCH ASSEMBLY

TECHNICAL FIELD

The present invention relates generally to magnetic alarm sensors and, in particular, to a method and an apparatus employing a compact magnetic security switch assembly for detecting the open or closed position of corresponding fixed frame and movable closure members, such as door and window assemblies, of buildings utilizing a disc-shaped rare earth, preferably neodymium, alloy magnet that is adaptable to unobtrusive and noninvasive shallow recess or surface mounting.

BACKGROUND OF THE INVENTION

Security alarm systems that detect and actuate an alarm when a door, window, or movable closure member of another entryway is opened conventionally employ a magnetic switch assembly such as illustrated in FIG. 1. Prior art switch assembly 10 includes an elongate magnet 12 and a corresponding magnetic switch 14, which are recess mounted in movable closure member 16 and fixed frame member 18, respectively, so that magnet 12 and switch 14 are in the juxtaposed axial alignment shown when the door, window, or other entryway is in a closed position. FIG. 1 shows that the housings for elongate magnet 12 and magnetic switch 14 are of the same size.

FIG. 2 illustrates the magnetic and electrical components in a schematic depiction of prior art security switch assembly 10. When magnet 12 and switch 14 are placed in axial alignment within a predetermined gap 20, magnetic field 22 and electrical contacts 24 interact so as to place switch 14 in a nonalarm state. Beyond gap 20 is a break distance 26 delineating the threshold proximity between magnet 12 and electrical contacts 24 at which the nonalarm state of switch 14 is maintained. Gap 20 and break distance 26 are measured between the opposed end faces of the housings for magnet 12 and magnetic switch 14. Between gap 20 and break distance 26 is a zone in which magnetic flux is of insufficient density to permit interactability with electrical contacts 24. Opening closure member 16 so as to move magnet 12 beyond break distance 26 places electrical contacts 24 outside of the interactive zone of magnetic field 22. Switch 14 thereby assumes an alarm actuation state.

Acceptable gap and break distances between the magnet and magnetic switch components of security switch assemblies have been established by industry standards based on customary mounting specifications, safety considerations, and market acceptance. Such acceptable gap distances are 12.5 millimeters (0.5 inch) for standard gap mounts and 25.5 millimeters (1.0 inch) for wide gap mounts.

Failure to comply with such well-established gap and break widths in mounting security switch assemblies gives rise to numerous problems, including serious safety hazards. An overly narrow gap fails to provide acceptable tolerances for accommodating standard clearances and expected irregularities, which result in misalignments and spaces between frames and corresponding closure members. If the gap between the switch and magnet components of an installed switch assembly has an irregularly wide space below standard tolerances, an increased false alarm actuation rate may result. A gap in excess of standard widths, on the other hand, introduces increased safety risks. This results from the risk that a closure member could be moved slightly ajar without actuation of the alarm. Thus, a potential burglar might be able to crack a door open far enough to tamper with and deactivate the alarm while the magnet remains within the threshold break distance. A very wide gap could even permit entry or unlocking of an inside latch or alternative entryway. It can thus be seen that compliance with established gap widths is important.

Referring again to FIG. 2, in order for a magnet to emanate a magnetic field 22 of sufficient strength to interact with electrical contacts 24 within acceptable tolerances for gap 20 and break distance 26, a certain magnetic flux density of magnet 12 must be sustained. Sustenance of the flux of a magnetic material is defined by its intrinsic coercive force, which is defined by its resistance to demagnetization forces. The intrinsic coercive force of a material is measured in oersteds.

Conventional security switch magnetic materials, such as alnico (aluminum, nickel, cobalt) are characterized by low levels of intrinsic coercive force. The low resistance to demagnetizing forces of alnico magnets results in sizable loss of magnetic flux density relative to a slight decrease in magnetic force. As a result, an alnico magnet cannot recover its original flux output without being remagnetized. The low level of magnetic force places geometric constraints on a conventional security switch magnet in which relatively very high length-to-diameter ratios are required to provide sufficient intrinsic coercive force to maintain acceptable magnetic flux levels for the expected life of a security switch assembly. A typical prior art alnico security switch magnet that is not susceptible to demagnetization has a length-to-diameter ratio of greater than 4-to-1 or more; therefore, an alnico magnet having a length-to-diameter ratio of less than 4-to-1 is susceptible to demagnetization. Due to such length-to-diameter constraints, conventional security switch magnets are bulky and elongate in configuration, as shown in FIGS. 1 and 2.

Such length-to-diameter constraints have rendered prior art security switch magnetic switches obtrusive and their installation invasive. Boring deep recesses to mount these elongate cylindrical magnets entails awkward and time-consuming procedures. The problems with installation are magnified when a security switch assembly is mounted in a tight space. Deep recess preparation in such a tight space is inconvenient, entailing the manipulation of tools around corners and proximate surfaces. This can result in imprecise recess boring and resulting misaligned installment. A most unfortunate consequence could be an unacceptable gap or break distance giving rise to potential safety hazards, as well as technical problems.

Another problem with prior art magnetic security switches results from boring recesses of a depth commensurate to the elongate cylindrical configuration of prior art magnets. Recess mounting of prior art magnets generally damages surface materials, such as laminates and veneers. For example, for vinyl clad windows, deep recesses damage the subsurface structural integrity located more than 4.0 millimeters (0.16 inch) below the surface of the component on which the security switch is mounted. Doors and window frames in which security switch magnets are mounted typically measure less than 3.8 to 6.35 centimeters (1.5 to 2.5 inches) in width. At this thickness, wood material, from which such structures are most often composed, becomes more prone to splintering and splitting when subject to deep boring.

A particular disadvantage of recess boring required to install elongate prior art magnets results from the frequent, if not inevitable, puncture of or damage to vinyl cladding or other thermal insulation material covering a movable closure structure, which is typically a window, on which such magnets are installed. Thus, damaging the insulation violates the integrity of the thermal field and reduces thermal efficiency of the relevant interior. As a result, acceptable thermal ratings, which are required by some building codes, are not attained. Perhaps most significantly, warranties on such insulation materials are typically invalidated because of punctured or damaged insulation.

The numerous drawbacks associated with prior art security switch magnets are compounded when security switch assemblies are installed in tight-fitting structures with close clearances, particularly windows. For instance, puncturing of vinyl cladding when mounting a security switch in windows having tight thermal fits causes particular perplexity, for obtaining an improved thermal rating and/or insulation warranty is often a primary purpose for installing such windows.

Until now, there has been no magnetic security switch assembly addressing the above problems with the prior art. There persists, therefore, an ongoing need for a readily and noninvasively installable security switch assembly having an unobtrusive magnet with acceptable magnetic force and density.

SUMMARY OF THE INVENTION

The present invention provides a method and an apparatus for a magnetic security switch assembly employing a rare earth alloy magnet that does not have the configurative constraints and associated problems of prior art security switches assemblies. The invention more particularly provides a magnetic security switch assembly for detecting the open or closed position of a movable closure member seatable in a fixed frame member of an entryway of a building.

The switch assembly includes a generally flat rare earth alloy magnet that is mountable on the movable closure member within a close clearance of the fixed frame member such that mounting of the magnet does not invade the subsurface structural integrity of the movable closure member. The rare earth alloy magnet according to this invention is characterized by an intrinsic coercive force that exceeds about 7,000 oersteds. Currently available magnets of this type can provide intrinsic coercive forces of up to 30,000 oersteds. The security switch assembly of the present invention further includes a magnetic switch having electrical contacts positioned along a switch axis and adapted for assuming a nonalarm state when the contacts are axially aligned with the magnet within a predetermined gap so as to interact with the magnetic field and assuming an alarm state when the magnet is moved past a predetermined break distance beyond which the contacts do not interact with the magnetic field.

The method of the present invention provides a compact security switch in an assembly for detecting the open or closed position of a movable closure member for an entryway of a building having a fixed frame member. The security switch includes a magnetic switch that is operatively attached to the fixed frame member and a magnet that is operatively attached to the movable closure member. The magnet is mountable within a close clearance of the fixed frame member and within a predetermined gap between the magnet and the magnetic switch such that the subsurface structural integrity of the movable closure member remains intact. In this method, a generally flat rare earth alloy magnet is mounted on the movable closure member and the magnetic switch is mounted on a fixed frame member. The electrical contacts assume a first or nonalarm state when the electrical contacts are axially aligned with the magnet within a predetermined gap so as to interact with the magnetic field of the magnet when the movable closure member is in closed position, and the electrical contacts assume a second or an alarm state when the movable closure member is in opened position so that the magnet is moved past a predetermined break distance from the magnetic switch beyond which distance the contacts do not interact with the magnetic field of the magnet.

As used herein for vinyl clad windows, subsurface structural integrity refers to the intact inner matrix lying more than 4.0 millimeters (0.16 inch) below the surface of a material of which the relevant structure is constructed. In context of the invention described and claimed herein, the subsurface structural integrity of a movable closure member is not invaded (i.e., left intact) when a magnet is mounted on a surface or in a recess having a depth of no more than 4.0 millimeters (0.16 inch).

The rare earth component of the security switch magnet alloy may vary, and is preferably neodymium. The proportion of the neodymium in the magnetic material may vary, ranging between about 10 percent and about 15 percent of the magnet. The rare earth component may, alternatively, be samarium cobalt constituting the same proportion of the magnetic material.

Alternative embodiments of the present invention may include magnets of various sizes and configurations. The thickness (i.e., length) of the magnet may measure between about 3.0 millimeters (0.12 inch) and about 4.0 millimeters (0.16 inch). The diameter may measure between about 9.5 millimeters (0.375 inch) and 16.0 millimeters (0.625 inch). Thus, the magnet of the present invention can be conveniently and unobtrusively mounted on a surface or a shallow recess having a depth of less than about 4.0 millimeters.

In a preferred embodiment of the present invention, which is described in greater detail below, the rare earth alloy magnet is in the configuration of a disc. The disc may include a center aperture with a diameter measuring about 3.0 to 4.0 millimeters (0.12 to 0.16 inch). The flat disc configuration of this magnet provides numerous advantages. The compact configuration permits more versatile mounting options for placement of the security switch assembly than prior art assemblies, particularly in structures having close clearances and tight tolerances. The disc configuration provides the particular advantages of permitting mounting in grooves and within close clearances. The compact configuration facilitates mounting the security switch assembly in small, awkward spaces that are not readily accessible and often lead to misaligned installment and may even result in later malfunction of the security system.

Further advantages provided by the present invention include the reduced risk of damage to the material on which the magnet and magnetic switch is mounted. In the event the material includes an insulation, such as vinyl cladding, avoidance of damaging or puncturing the insulation improves the thermal efficiency and thus preserves thermal ratings required by some building codes. Avoidance of damage to vinyl cladding or other insulation material provides the advantage of maintaining the validity and effect of insulation warranties which typically require that the integrity of the thermal field or insulation not be punctured or damaged.

The scope of the invention is defined in the claims. The organization and interrelation of the components and method of operation, together with further advantages and objects thereof, however, may best be understood by reference to the following description taken in connection with the accompanying drawings in which reference characters correspond to the referenced components of the drawings.

BRIEF DESCRIPTION OF THE DRAWINGS

FIG. 7 is a fragmentary isometric drawing illustrating the magnet in a shallow recess mounting in a sliding door.

FIG. 8 is a cross-sectional view of the recess mounting shown in FIG. 7 taken along lines VIII—VIII.

DETAILED DESCRIPTION OF THE INVENTION

Figure 1:
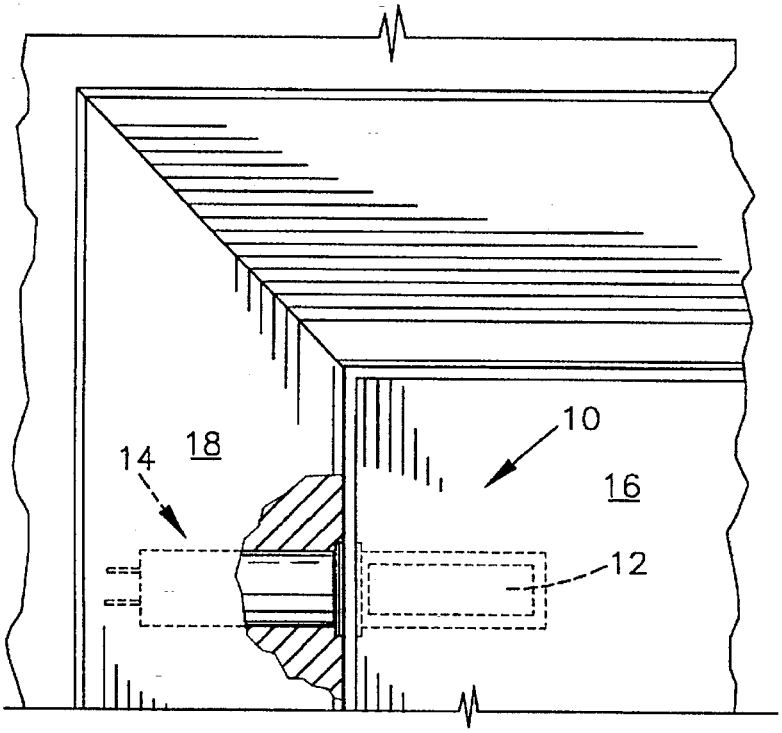
FIG. 1 Prior Art
FIG. 1 is a simplified diagram of a conventional security switch assembly installed in a door.
Figure 2:
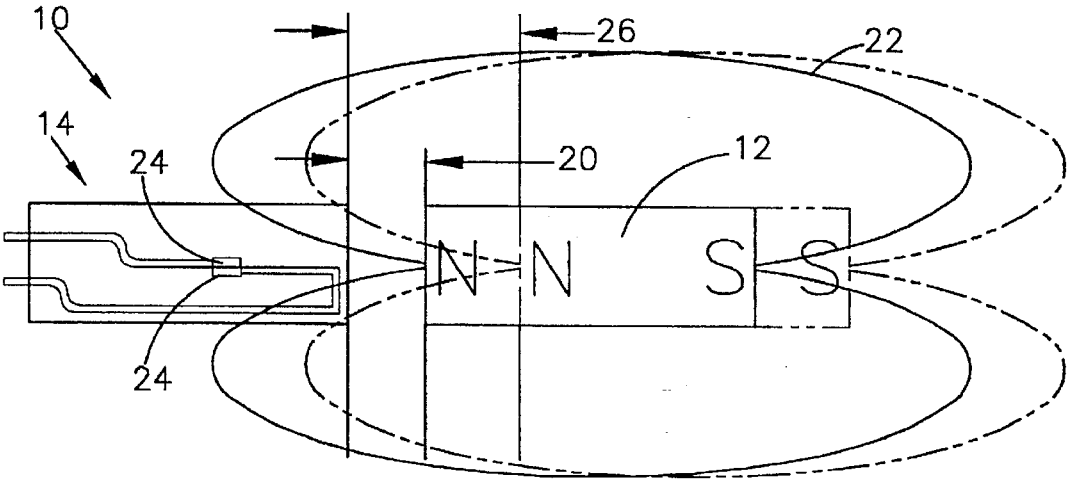
FIG. 2 Prior Art
FIG. 2 is a simplified representation of a conventional magnetic security switch assembly and associated magnetic field components.
Figure 3:
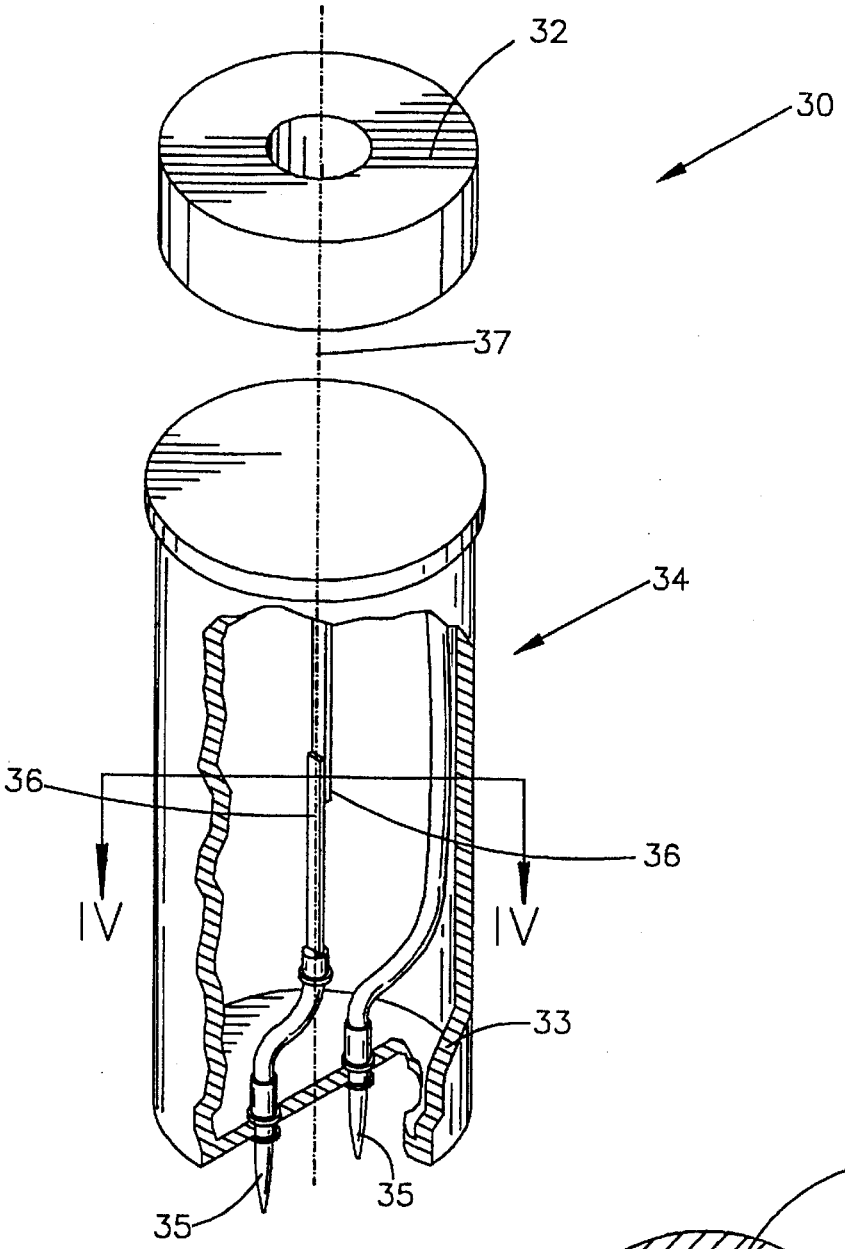
FIG. 3 is a simplified isometric drawing illustrating a side perspective view of the security switch of the present invention.
Figure 4:
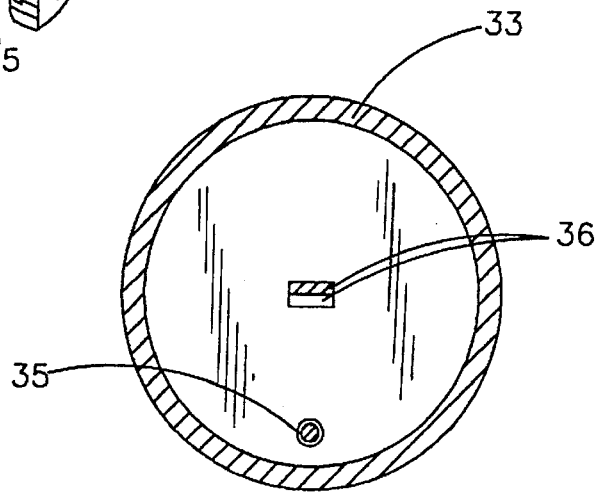
FIG. 4 is a cross-sectional view of the surface mounting of the magnet shown in FIG. 3 taken along lines IV—IV.

Referring to FIG. 3, security switch assembly 30 according to the present invention includes a magnet 32 and magnetic switch 34. Electrical contacts 36 are operatively positioned along a longitudinal switch axis 37, and supported by leads 35 within housing 33, of switch 34. When magnet 32 is axially aligned with magnetic switch 34 within a predetermined gap 46, electrical contacts 36 interact with a magnetic field produced by magnet 32 and thereby assume a closed or touching position that causes switch 34 to assume a nonalarm state. When magnet 32 is moved away from switch 34 beyond predetermined gap 46 and a break distance 48, electrical contacts 36 no longer interact with the magnetic field and assume an open or electrically noncontacting position that causes switch 34 to assume an alarm state. FIG. 4 is a cross-sectional view taken along lines IV—IV of FIG. 3 illustrating the abutted alignment of electrical contacts 36 when in the closed, nonalarm position.

The dimensions, composition, and magnetization of magnet 32 impart a magnetic flux density (i.e., strength) suitable for interaction with electrical contacts 36 when positioned at a "standard" 12.7 millimeter (0.5 inch) and a "wide" 25.4 millimeter (1.0 inch) gap distance from magnetic switch 34 established by industry practices and customer acceptance further described herein. Because of their high intrinsic coercive forces, neodymium and other rare earth alloy magnets do not require a high length-to-diameter ratio to retain the magnetic flux density of the magnetic field to interact with electrical contacts within those predetermined gap and break distances. Gap and break distance tolerances of security switch assembly 30 according to the present invention correspond to the composition, dimensions and geometry, and magnetization of magnet 32. Gap 46 and break distance 48 are measured between the opposed end faces of magnet 32 and housing 33 of switch 34.

In a preferred embodiment, as illustrated in the drawings, magnet 32 is composed of a neodymium-iron-boron alloy having an intrinsic coercive force of about 10,000 oersteds and a magnetic flux density of about 7,000 gauss. The alloy of magnet 32 is composed of 10 percent neodymium, 85 percent iron and 5 percent boron.

In this preferred embodiment, magnet 32 measures 3 millimeters (0.12 inch) in length and either 10 millimeters (0.4 inch) or 15 millimeters (0.6 inch) in diameter. The length-to-diameter ratios of the 10 and 15 millimeter diameter magnets 32 are 1-to-3.3 and 1-to-5, respectively. As further described herein, the low profile and compact configuration of magnet 32 advantageously facilitates convenient, noninvasive and flexible mounting. The 10 millimeter diameter magnet 32 is typically used in an assembly 10 with a 12.5 millimeter (0.5 inch) gap and a 15.5 millimeter (0.625 inch) break distance. The 15 millimeter diameter magnet 32 is typically used in an assembly 10 with a 25.5 millimeter (1.0 inch) gap and a 32.0 millimeter (1.25 inch) break distance.

Magnet 32 is a commercially available part and has the general configuration of a disc. Machining of the rare earth alloy magnet in a suitable disc shape according to specifications can be performed by conventional grinding techniques known by persons skilled in the art. Because of the brittle nature of rare earth magnetic materials and the importance of attaining acceptable tolerances, the magnets should be made by skilled artisans and specialized machine tools.

Magnet 32 is coated with epoxy to prevent oxidation and resulting corrosion. A plastic housing (not shown) for encapsulating magnet 32 may also be provided to protect against degradation, fissures, breaks, chips, and other mechanical damage.

Figure 5:
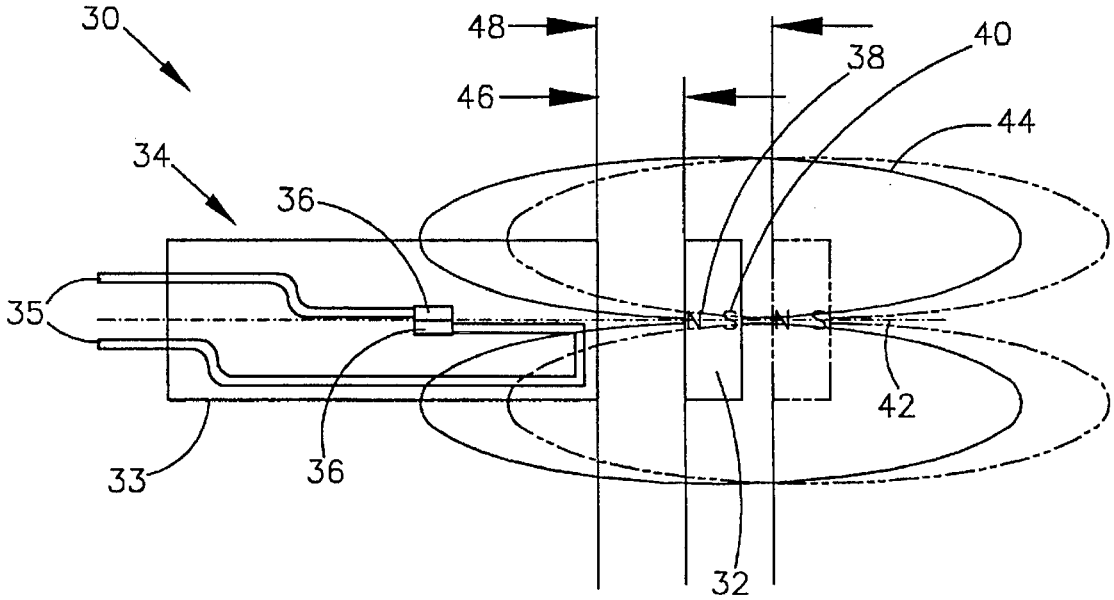
FIG. 5 is a simplified schematic diagram representing the interaction between the magnet and switch of the present invention.

FIG. 5 schematically represents the magnetic field line components of magnet 32 that interact with switch 34, particularly electrical contacts 36. Such magnetic field line components are imparted to the neodymium alloy by utilizing conventional procedures which is magnet 32 is magnetized in an isometric direction along a magnetic axis 42 between opposing magnetic north and south poles 38 and 40, respectively, that are generally aligned along a magnetic axis 42.

As illustrated in FIG. 5, magnetization of magnet 32 generates a magnetic field 44. When magnet 32 and switch 34 are proximally aligned along magnetic axis 42 so that electrical contacts 36 are within magnetic field 44, electrical contacts 36 are placed in a closed position and switch 34 assumes a nonalarm state. The displacement beyond gap 46 and break distance 48 may be axial, i.e., a vertical or horizontal sliding along a linear groove, or radial, i.e., an angular swing from a hinge. When magnet 32 is moved in a linear or radial direction so that field lines of magnetic field 44 are positioned beyond break distance 48, magnetic field 44 does not interact with electrical contacts 36, thereby placing them in an open position and switch 34 in an alarm state.

In FIGS. 3–5, electrical contacts 36 are shown in a contacting or closed state when magnet 32 is positioned within the gap 46 wherein magnetic field 44 interacts with electrical contacts 36. When magnet 32 is moved beyond the break distance 48, electrical contacts 36 assume a noncontacting or open state. The security switch of the present invention may alternatively employ electrical contacts that assume a nonalarm position in the contacting or open state and become contacting only in the absence of a magnetic field.

Figure 6:
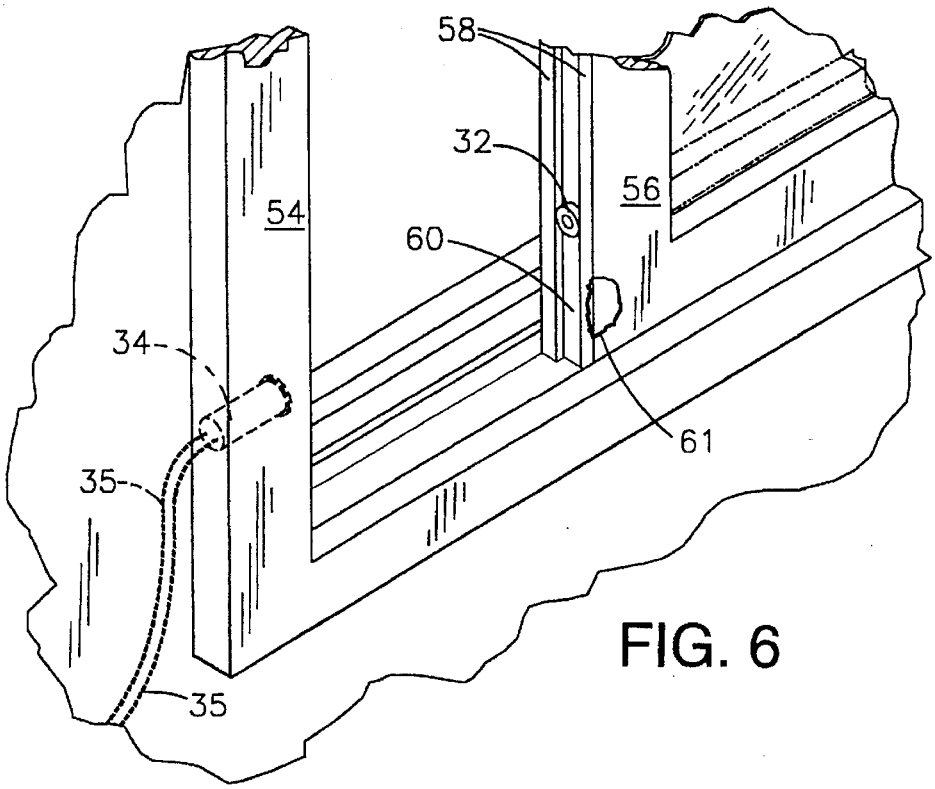
FIG. 6 is a fragmentary isometric drawing illustrating the magnet in a surface mounting in a window.

When mounted, as illustrated in FIGS. 6–8, switch 34 and magnet 32 are axially aligned so that the interaction of electrical contacts 36 and magnetic field 44 occurs within acceptable tolerances for a predetermined gap and break distance.

FIG. 6 depicts switch assembly 30 installed in a sliding window that includes a fixed frame member 54 and a movable closure member 56. The movable closure member 56 of the window has a sidewall 60 in which groove 60 has been extruded. Groove 60 receives and seats corresponding outer edges of fixed frame member 54. Movable closure member 56 is covered with vinyl cladding 61, which provides thermal insulation. Magnet 32 is adhered by epoxy to the lower flat surface of groove 60 without puncturing or damaging vinyl cladding 61 to provide a standard 12.5 millimeter (0.5 inch) gap. When mounted as shown in FIG. 6, the flat and compact configuration of magnet 32 provides for unobtrusive mounting, in which the uppermost surface of magnet 32 does not protrude beyond sidewalls 58. Switch 34 is mounted in fixed frame member 54 within acceptable gap and break distance tolerances. Security switch assembly 30 is preferably mounted at a lower edge of fixed frame member 54 and movable closure member 56 such that even slight upward movement along its vertical axis will be detected.

Referring to FIG. 7, which illustrates magnetic security switch assembly 30 installed in a door, magnet 32 is shown mounted in a shallow recess 64. In this installation, subsequent to placement of magnet 32 in shallow recess 64, a screw 66 is inserted through a center aperture 68 with a diameter of about 3.2 millimeters (0.125 inch) and driven down into the movable closure member 62 to anchor magnet 32 in secured position. Switch 34 is mounted in a fixed frame member 70 so that magnet 32 is brought within acceptable gap and break distance tolerances when movable closure member 62 is in closed position.

As clearly depicted in FIG. 8, which provides a cross-sectional view taken along lines VIII—VIII of FIG. 7, recess 64 is bored to a depth that corresponds to the thickness (i.e., length) of magnet 32. Thus, the upper surface of magnet 32 does not protrude beyond the surface of movable closure member 62, and interference to placement of the relevant movable closure member in a closed position is minimized.

Figure 9:
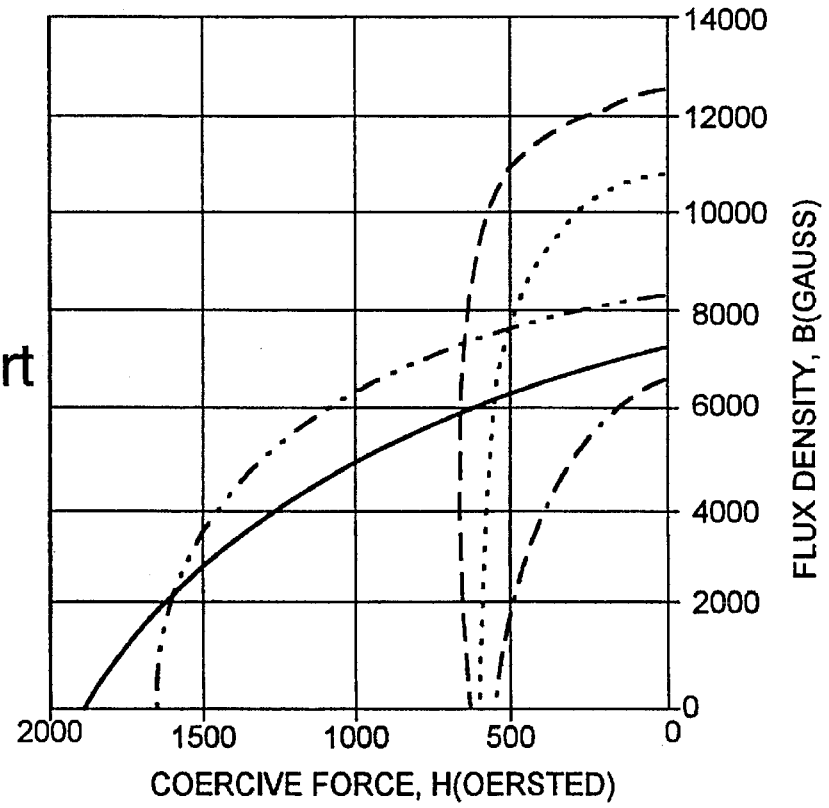
FIG. 9 Prior Art
FIG. 9 is a graph depicting the demagnetization curves of selected prior art alnico magnetic materials of five different grades.
Figure 10:
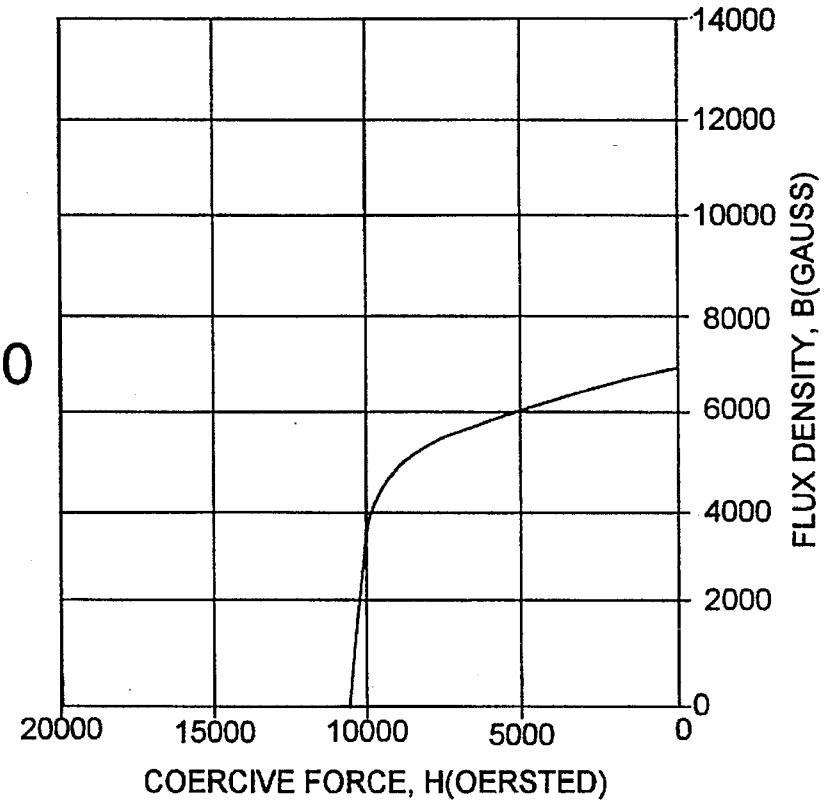
FIG. 10 is a graph depicting the demagnetization curve of an exemplary neodymium alloy magnetic material.

FIGS. 9 and 10 depict demagnetization curves that graphically illustrate the relative magnetic or intrinsic coercive force, i.e., resistance to demagnetization forces, of, respectively, five prior art alnico magnetic materials and neodymium iron boron. Demagnetization curves are extrapolations of second quadrant curves of the hysteresis loops of relevant magnetic materials and generally describe magnetic properties of the relevant materials in actual use. As shown by the curves depicted in FIG. 9, if the operating point of a magnet falls below the knee of the curve, small changes in intrinsic coercive force can produce sizable changes in magnetic flux density. The five curves in FIG. 9 represent alnico magnets of different grades that depend upon the amount of cobalt present. The magnets having greater concentrations of cobalt have higher maximum magnetic flux densities.

Referring to FIG. 9, it can be seen that very large changes in flux density occur with slight changes in intrinsic coercive force at the knee at about 600 to 800 oersteds of the demagnetization curve of the depicted exemplary alnico magnets.

In comparison, as shown in the demagnetization curve of the neodymium-iron-boron magnet depicted in FIG. 10, the knee is exhibited at a far greater intrinsic coercive force range of between about 8,000 and 10,000 oersteds. Thus, the data depicted on the graphs provided in FIGS. 9 and 10 demonstrate that the neodymium alloy magnetic material exhibits a substantially greater intrinsic coercive force than do the prior art alnico magnetic materials.

The security system of the present invention may be connected by a wire or other transmittance means to an alarm, a power supply, and/or a CPU in a control panel or other components of the alarm system. Persons skilled in the art will understand that known circuitry for implementing "door breach" and/or "door secure signals" may result in an indicator light, a sound element (such as a siren), or a remote alert at a monitoring station. Skilled persons will also appreciate that the wire could be replaced, for example, with a transmitter responsive to noncontacting states of electrical contacts.

It will be obvious to those having skill in the art that various changes may be made in the details of the present invention without departing from the underlying principles. Such skilled persons will recognize that alternative compositions, grades, shapes, and sizes may be employed to provide a rare earth alloy suitable for the security switch assembly claimed herein. This invention therefore includes any number of alternative embodiments employing rare earth alloy magnets having a variety of configurations and components. For example, skilled persons will appreciate that the present invention may employ magnets of other configurations, such as a horse shoe, bar, or other shape; other compositions; or other dimensions. The scope of the present invention should, therefore, be determined only by the following claims.

We claim:

1. A method for providing a compact security switch in an assembly for detecting the open or closed position of a movable closure member relative to a fixed frame member, the security switch including a magnetic switch that is operatively attached to the fixed frame member and a magnet that is operatively attached to the movable closure member such that its subsurface structural integrity remains intact, the magnet being mountable within a close clearance of the fixed frame member and within a predetermined gap between the magnet and the magnetic switch, comprising:

providing the movable closure member configured for seating within the fixed frame member;

mounting on the movable closure member such that its subsurface structural integrity remains intact a rare earth alloy magnet characterized by an intrinsic coercive force exceeding about 7,000 oersteds; and mounting on the fixed frame member a magnetic switch having electrical contacts positioned along a switch axis such that the electrical contacts assume a first alarm state when the electrical contacts are axially aligned with the magnet within a predetermined gap between the magnet and the magnetic switch so as to interact with the magnetic field of the magnet when the movable closure member is in a closed position and that the electrical contacts assume a second alarm state when the movable closure member is opened and the magnet is moved past a predetermined break distance from the magnetic switch beyond which distance the electrical contacts do not interact with the magnetic field.

2. The method of claim 1, wherein the rare earth alloy magnet comprises neodymium.

3. The method of claim 1, wherein the rare earth alloy comprises neodymium iron boron.

4. The method of claim 1, wherein the rare earth alloy comprises samarium cobalt.

5. The method of claim 1, wherein the magnet is in the general configuration of a disc having a length of between about 3.0 millimeters and about 4.0 millimeters, a diameter of between about 9.5 millimeters and about 16.0 millimeters.

6. The method of claim 1, wherein the magnet is in the general configuration of a disc having a length of between about 3.0 millimeters and about 4.0 millimeters, a diameter of between about 9.5 millimeters and about 16.0 millimeters, and a center aperture having a diameter of between about 3.0 millimeters and about 4.0 millimeters.

7. The method of claim 1, wherein the predetermined gap between the magnet and the magnetic switch is between about 12.5 millimeters and about 25.5 millimeters.

8. The method of claim 1, wherein the predetermined break distance between the magnet and the magnetic switch is between about 15.5 millimeters and about 32.0 millimeters.

9. The method of claim 1, wherein mounting the rare earth alloy magnet further comprises adhering the magnet to the surface of the fixed frame member.

10. The method of claim 1, wherein the magnet is in the general configuration of a disc having a center aperture and wherein mounting the rare earth alloy magnet further comprises inserting a fastener through the center aperture and downwardly into the fixed frame member to secure the magnet thereto.

11. The method of claim 1, wherein the magnet is mounted in a groove of the sidewall of the fixed frame member so that protrusion of the magnet beyond the extrusion is minimized.

12. The method of claim 1, wherein the magnet is mounted in a shallow recess having a depth of less than about 4.0 millimeters.

13. The method of claim 1, wherein the movable closure member is covered with insulation material that is not punctured when the magnet is mounted thereon.

14. The method of claim 1, wherein the movable closure member is covered with vinyl cladding that is not punctured when the magnet is mounted thereon.

15. A compact security switch assembly for detecting the open or closed position of a movable closure member seatable in a fixed frame member, the movable closure member having a surface structure, comprising:

a rare earth alloy magnet characterized by an intrinsic coercive force exceeding about 7,000 oersteds and mountable to the movable closure member within a close clearance of the fixed frame member such that the subsurface structural integrity of the movable closure member remains intact; and a magnetic switch having electrical contacts positioned along a switch axis, the electrical contacts adapted for assuming a first alarm state when the electrical contacts are axially aligned with the magnet within a predetermined gap between the magnet and the magnetic switch so as to interact with the magnetic field and a second alarm state when the magnet is moved past a predetermined break distance from the magnetic switch beyond which distance the electrical contacts do not interact with the magnetic field.

16. The switch assembly of claim 15, wherein the rare earth alloy comprises neodymium.

17. The switch assembly of claim 15, wherein the rare earth alloy comprises neodymium iron boron.

18. The switch assembly of claim 15, wherein the rare earth alloy comprises samarium cobalt.

19. The switch assembly of claim 15, wherein the magnet is in the general configuration of a disc having a length of between about 3.0 millimeters and about 4.0 millimeters and a diameter of between about 9.5 millimeters and about 16.0 millimeters.

20. The switch assembly of claim 15, wherein the magnet is in the general configuration of a disc having a length of between about 3.0 millimeters and about 4.0 millimeters, a diameter of between about 9.5 millimeters and about 16.0 millimeters, and a center aperture having a diameter of between about 3.0 millimeters and about 4.0 millimeters.

21. The switch assembly of claim 15, wherein the predetermined gap between the magnet and the electrical contacts is between about 12.5 millimeters and about 25.5 millimeters.

22. The switch assembly of claim 15, wherein the predetermined break distance between the magnet and the magnetic switch is between about 15.5 millimeters and about 32.0 millimeters.

* * * * *